United States Patent [19]

Hunt

[11] Patent Number: 4,492,210

[45] Date of Patent: Jan. 8, 1985

[54] SERVICEABLE VALVE CONSTRUCTION

[75] Inventor: Donald E. Hunt, New Haven, Mo.

[73] Assignee: Ballwin-Washington, Inc., Washington, Mo.

[21] Appl. No.: 467,774

[22] Filed: Feb. 18, 1983

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 3,646,923 | 3/1972 | Sarto | 123/568 |
| 3,713,428 | 1/1973 | Sandhagen | 123/568 |
| 3,972,312 | 8/1976 | Walker | 123/568 |
| 3,974,807 | 8/1976 | Nohira et al. | 123/568 |
| 4,044,739 | 8/1977 | Miura et al. | 123/568 |
| 4,080,941 | 3/1978 | Bertrand | 123/568 |

FOREIGN PATENT DOCUMENTS

| | | | |
|---|---|---|---|
| 2712511 | 7/1978 | Fed. Rep. of Germany | 123/568 |
| 2089428 | 6/1982 | United Kingdom | 123/568 |

*Primary Examiner*—Wendell E. Burns

*Attorney, Agent, or Firm*—Neuman, Williams, Anderson & Olson

[57] ABSTRACT

A serviceable valve is provided for controlling the recirculation of exhaust gases within an internal combustion engine. The valve includes a housing having a first section provided with an interior chamber and a second section secured to and subtending said first section. A diaphragm is affixed to and interposed the housing sections and is in communication with the chamber. In response to a predetermined chamber pressure, the diaphragm is distorted in one direction from a predetermined rest position. The housing is mounted on a fitting, which subtend the housing second section, whereby said housing and the diaphragm are rotatable as a unit about an axis of the fitting to selected positions of adjustment. The fitting is removably mounted on the engine. Carried on the diaphragm is a stem assembly which is movable longitudinally in response to the distortion of the diaphragm. A portion of the stem assembly extends through and protrudes from the fitting and has a valve piece mounted thereon. The valve piece is adapted to coact with a valve seat disposed within a recirculation flow path of the engine exhaust gases and, when seated thereon, blocks recirculation of the exhaust gases through the engine. The housing first section is provided with a port offset from the fitting axis and adapted to be removably connected to a pressure fluctuating segment of the engine. Means is provided which coacts with the fitting and the housing second section and releasably retains the housing and diaphragm in a selected position of adjustment relative to the fitting.

3 Claims, 14 Drawing Figures

FIG. 1
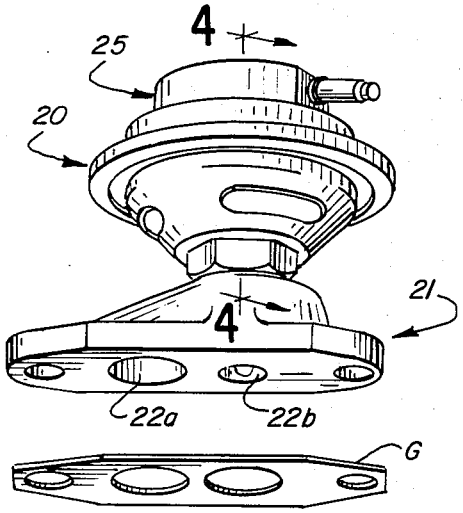
FIG. 2
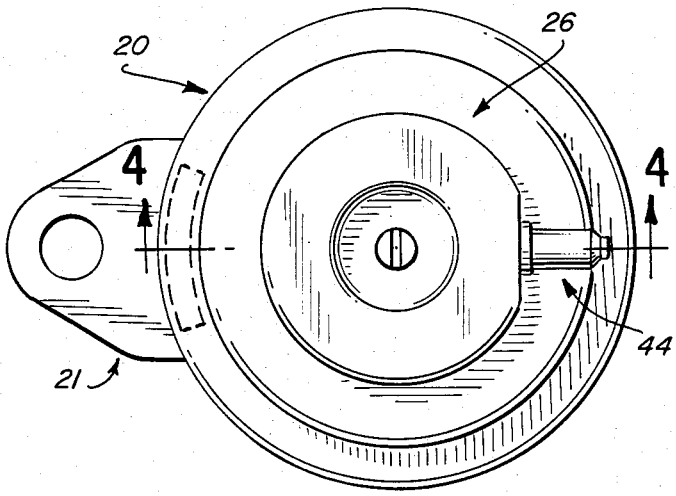
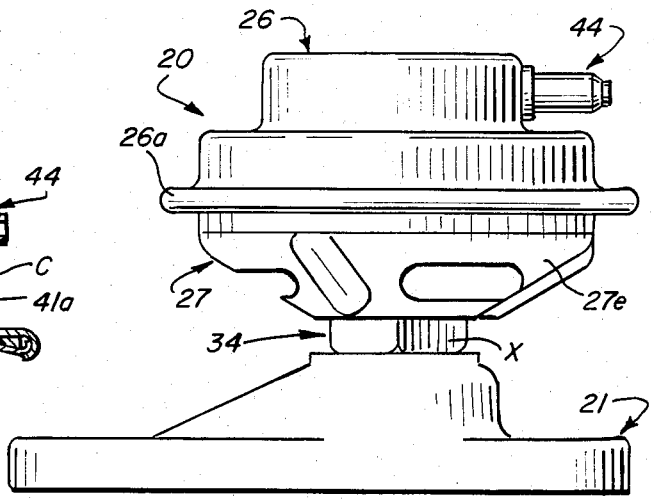
FIG. 3
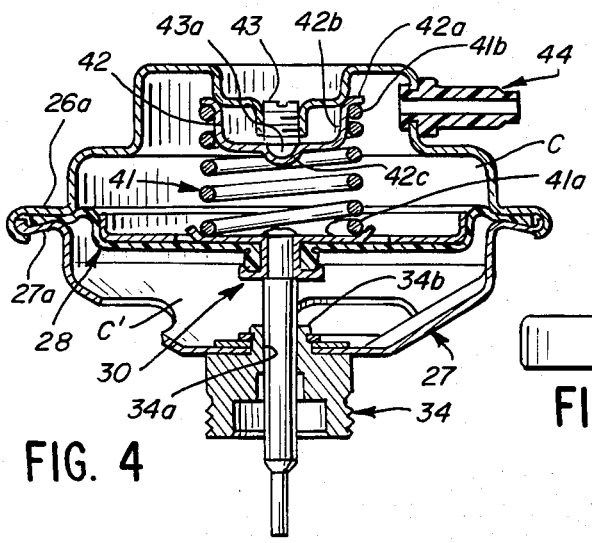
FIG. 4
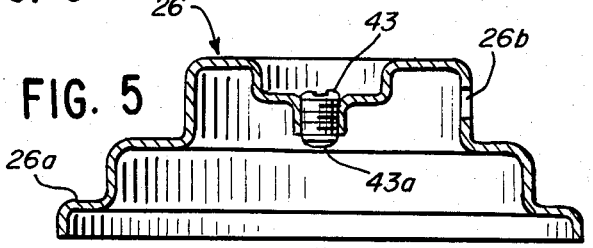
FIG. 5
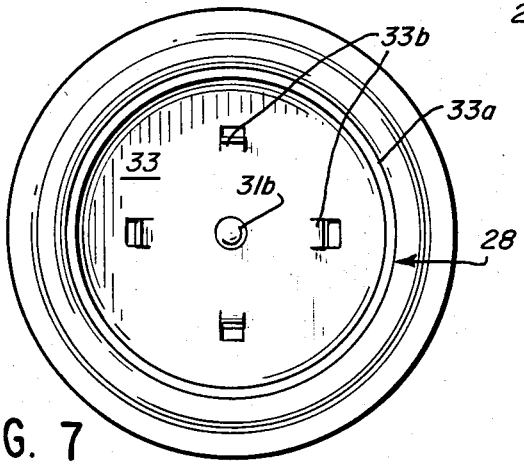
FIG. 7
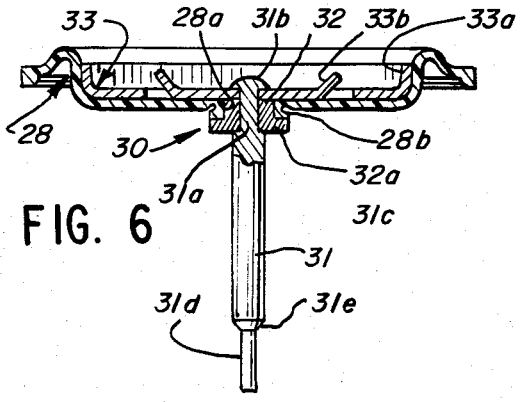
FIG. 6

FIG. 8
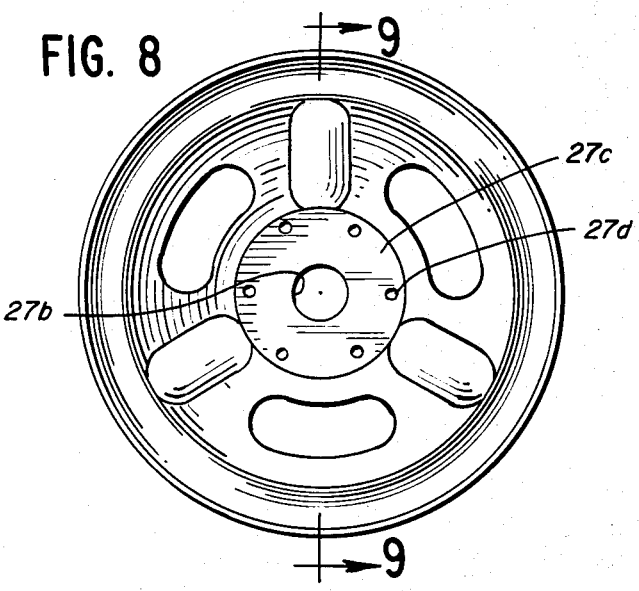
FIG. 12
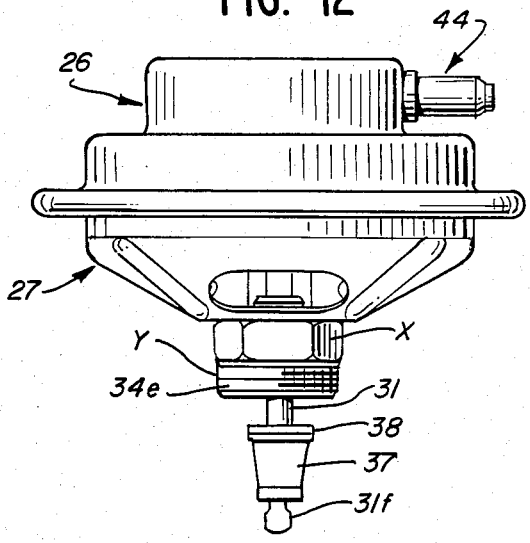
FIG. 9
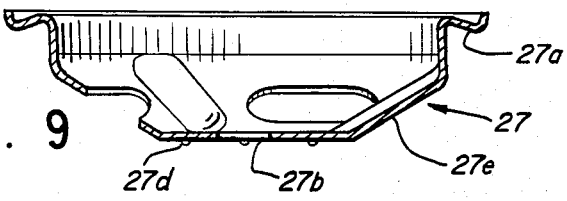
FIG. 10
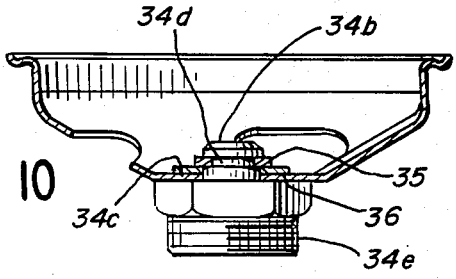
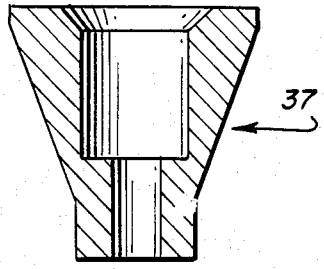
FIG. 13
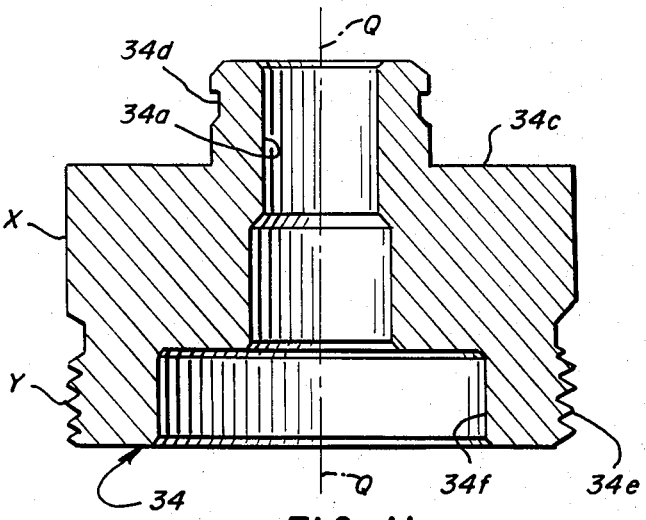
FIG. 11
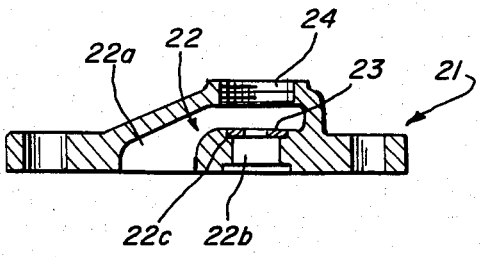
FIG. 14

SERVICEABLE VALVE CONSTRUCTION

BACKGROUND OF THE INVENTION

Because of the environment in which exhaust gas recirculation valves normally operate, they are highly susceptible to carbon buildup resulting in malfunction. Heretofore valves of this general type were not readily capable of being at least partially disassembled for cleaning and, thus, in lieu of cleaning it became customary to replace the entire valve, thereby significantly increasing maintenance costs.

In most present day vehicles there are severe limitations in the space provided under the hood to accommodate the engine and the various accessory components associated therewith. As a result of this condition, it is necessary that the vacuum tube connected to a section of the valve housing be placed in a precise location so as not to interfere with any parts or components of the engine. As a result of such space limitations, the precise locating of the valve within the space, and the variation in the size and location of the vacuum tube connected to the valve, a proliferation of modified versions of the valve, commonly referred to as an EGR valve, has resulted even though the flow specifications and operating characteristics thereof are the same. Thus, an auto or truck mechanic is required to maintain a substantial inventory of the various valves so that repair and maintenance of the engine can be expeditiously performed. The cost of maintaining such an inventory and of obsolescence of such valve inventory due to changes in styling and size of the vehicle engine and body oftentimes imposes a severe financial burden on the mechanic or his employer.

SUMMARY OF THE INVENTION

Thus, it is an object of this invention to provide a valve which readily overcomes the aforenoted problems associated with prior valves of this general type.

It is a further object to provide a valve of simple, compact, yet sturdy construction and which may be readily serviced for cleaning or the like without causing the valve to be multilated or defaced and, thus, necessitating replacement thereof.

It is a further object to provide a valve wherein a portion thereof may be rotated as required to facilitate connecting a vacuum tube or the like to such portion without causing relocation of any engine component or part.

It is a further object to provide a valve wherein the portion thereof to which a vacuum tube or the like is connected can be rotated in either direction through an arc of 360° and will automatically remain in a selected position of rotational adjustment.

Further and additional objects will appear from the description, accompanying drawings, and appended claims.

In accordance with one embodiment of the invention, a serviceable valve of the type described is provided which is particularly suitable for use in controlling the recirculation of exhaust gases in an internal combustion engine. The valve includes a housing having a first section provided with an interior chamber and a second section secured to and subtending the first section. Interposed the housing sections and affixed thereto is a diaphragm having one surface thereof communicating with the chamber. When a predetermined pressure develops within the housing chamber, the diaphragm will respond thereto and become distorted in one direction from a normal rest position. The housing second section is mounted on a subtending fitting whereby the housing and diaphragm will rotate as a unit about an axis defined by a portion of the fitting. The fitting is adapted to be removably mounted on a portion of the engine wherein the exhaust gases would flow during recirculation. Carried on the diaphragm and being movable in response to the distortion thereof is a stem assembly. The assembly embodies an elongated stem having a portion thereof slidably extending through a suitable opening formed in the fitting and having a valve piece secured to an end portion of the stem protruding from the fitting opening. The valve piece is adapted to coact with a valve seat disposed in the flow path of the recirculating exhaust gases whereby, when the valve piece is seated on the valve seat, recirculation of the exhaust gases through the engine is blocked. Communicating with the interior chamber of the housing first section is a port which is offset with respect to the fitting axis about which the housing and diaphragm rotate as a unit. The port is adapted to be removably connected to one end of a vacuum tube or the like. The housing second section and the fitting are provided with complemental means which coact to releasably retain the housing and diaphragm in a selected position of adjustment relative to the fitting.

DESCRIPTION

For a more complete understanding of the invention, reference should be made to the drawings wherein:

FIG. 1 is a perspective bottom view of one form of the improved valve shown mounted on a base member removed from an internal combustion engine.

FIG. 2 is an enlarged top view of the valve of FIG. 1.

FIG. 3 is a side elevational view of the valve of FIG. 2 shown assembled on the base member.

FIG. 4 is a fragmentary sectional view taken along line 4—4 of FIG. 2 and showing the valve disassembled from the base member.

FIG. 5 is a vertical sectional view of the housing first section per se.

FIG. 6 is a fragmentary vertical sectional view of the diaphragm and stem assembly carried thereby.

FIG. 7 is a top plan view of the diaphragm per se.

FIG. 8 is a bottom view of the housing second section.

FIG. 9 is a sectional view taken along line 9—9 of FIG. 8.

FIG. 10 is similar to FIG. 9 but showing the housing second section mounted on the fitting.

FIG. 11 is an enlarged vertical sectional view of the fitting shown in FIG. 10.

FIG. 12 is a side elevational view of the valve removed from the engine and showing the valve piece affixed to the lower end of the stem.

FIG. 13 is an enlarged vertical sectional view of the valve piece per se.

FIG. 14 is a vertical sectional view of the base member shown in FIG. 1.

Referring now to the drawings, one form of the improved valve 20 is shown which is adapted to be mounted on a base member 21, the latter forming a part of an internal combustion engine. The base member 21 is adapted to overlie a portion of the engine's exhaust manifold, now shown, and is provided with an internal passageway 22 through which exhaust gases are adapted to flow. Interposed the base member 21 and the engine manifold is a conventional gasket G. The passageway 22 includes first and second segments 22*a* and 22*b* which are angularly disposed relative to one another and separated by a valve seat 23. The valve seat 23 in the illustrated embodiment has a ringlike configuration and is formed of suitable material (e.g. stainless steel). The valve seat 23 is mounted on a suitable ledge 22*c* formed at one end of the second segment 22*b* of the passageway. Disposed above valve seat 23 and in axial alignment with the second segment 22*b* is an internally threaded opening 24 in which the valve 20 is mounted as will be described more fully hereinafter.

Valve 20 includes a housing 25 which has a first, or upper, section 26 (see FIG. 5) and a second, or lower, section 27 (see FIG. 9). Each section is provided with a peripheral outwardly projecting shoulder or flange 26*a*, 27*a*. The shoulders are adapted to mate with one another in face-to-face relation. The outer edge of shoulder 26*a* is adapted, when the housing sections are assembled together, to encompass shoulder 27*a* and to be crimped thereunder.

Extending across and separating the interiors of the housing sections 26, 27 is a diaphragm 28 formed of suitable resilient material (e.g. Silicone 45 Duro) which is capable of withstanding operating temperatures in excess of 450° F. The diaphragm coacts with housing section 26 to form an interior chamber C, see FIG. 4. The periphery of the diaphragm is sandwiched between the shoulders 26*a*, 27*a* of the housing sections.

Carried on the diaphragm 28 and disposed at the center thereof is a stem assembly 30, see FIG. 6. Assembly 30 includes a depending elongated stem piece 31 having the upper end 31*a* thereof reduced in size and extending through a central opening 28*a* formed in the diaphragm. The opening is delimited by a reinforcing flange 28*b*. Disposed within the diaphragm opening 28*a* and encompassing the reduced end 31*a* of the stem is a bushing 32. The lower end of the bushing is provided with an external shoulder 32*a* which subtends and engages the depending end of the reinforcing flange 28*b* of the diaphragm. The upper end of the bushing abuts the underside of a disc-shaped plate 33 which encompasses the reduced end 31*a* of the stem 31 and extends radially outwardly therefrom and overlies a substantial area of the diaphragm surface adjacent the interior chamber C of housing section 26. The outer periphery of plate 33 is delimited by an upwardly extending reinforcing flange 33*a*. A portion of the diaphragm conforms substantially to the curved configuration of flange 33*a*. Intermediate the center of the plate and the flange 33*a* are a plurality of symmetrically arranged struckouts 33*b* which project upwardly into chamber C. The function of the struckouts will be described more fully hereinafter.

The plate 33, bushing 32, and diaphragm 28 may be retained in assembled relation with respect to the stem piece 31 by the tip 31*b* of the latter, which projects into chamber C a slight amount, being peened or otherwise enlarged so that the plate, bushing, and diaphragm are locked in place between a shoulder 31*c* formed on the stem piece 31 and the enlarged tip 31*b*.

The housing second section 27 is mounted on a fitting 34, which subtends same, whereby the housing sections 26, 27 and the diaphragm 28 are adapted to rotate as a unit about an axis of the fitting. The axis is defined by an opening 34*a* formed in the fitting in which a portion of the stem piece 31 is slidably disposed, see FIG. 4. Fitting 34 is provided with a cylindrical protuberance 34*b* formed on the upper surface 34*c* thereof. The protuberance extends through an opening 27*b*, see FIGS. 8–10, formed in the underside of the housing second section 27 and terminates within the interior C′ of the second section, see FIGS. 4 and 10. An external groove 34*d* is formed in the protuberance 34*b* for accommodating a retaining ring 35. The ring overlies and engages a spring washer 36 which, in turn, encompasses protuberance 34*b* and resiliently contacts the surface 27*c* of the housing second section in which opening 27*b* is formed. Because of the spring force exerted on surface 27*c* by spring washer 36, the housing surface 27*c* and the fitting surface 34*c* are maintained in resilient abutting face-to-face relation. As noted in FIG. 8, surface 27*c* is provided with a plurality of symmetrically arranged detents 27*d*, the function of which will be described more fully hereinafter.

The wall 27*e* of the housing second section 27 which interconnects the upper peripheral shoulder 27*a* with surface 27*c* has a substantially frusto-conical configuration. A plurality of access openings 27*f* are provided in wall 27*e* to facilitate assembly and disassembly of the housing 25 with respect to fitting 34. The openings 27*f* also permit ventilation of chamber C′.

As observed in FIGS. 10 and 11, the portion 34*e* of the fitting which depends from the housing surface 27*c* has a polygonal first segment X, and an externally threaded second segment Y which depends therefrom. Segment Y is adapted to be threaded into the opening 24 formed in base member 21. The polygonal configuration of segment X enables a wrench or the like to be used in assembling the fitting segment Y in the base member opening 24.

As will be observed in FIG. 12, the lower end 31*d* of the stem piece 31 projects downwardly from fitting segment Y and has mounted thereon a suitable valve piece 37 which is adapted to engage valve seat 23 provided in base member 21 and block flow of the exhaust gases through passageway 22. The end portion 31*d* of the stem piece 31 is reduced in size thereby forming a shoulder 31*e* against which the valve piece is positioned when the latter is mounted thereon. If desired, one or more washers 38 may be positioned between the top of the valve piece and the stem piece shoulder 31*e*. The valve piece is retained on the lower end 31*d* of the stem piece by the tip 31*f* of the end being deformed so as to be enlarged, see FIG. 12.

As seen in FIG. 11, the lower end of the opening 34*a* formed in fitting 34 is counterbored so as to accommodate the upper end of the valve piece 37 and washers 38, when the valve piece is retracted from valve seat 23. In the illustrated embodiment, the valve piece 37 is normally seated on valve seat 23 by reason of a biasing spring assembly 40 disposed within the chamber C of the housing first section 26, see FIG. 4. The spring assembly includes a coil spring 41 having the lower end 41*a* thereof engaging the adjacent surface of plate 33 of the stem assembly 30, previously described. Lateral shifting of the spring end 41*a* relative to the plate surface is restrained by the plurality of symmetrically arranged struckouts 33*b* of plate 33. The upper end 41*b* of the spring 41 engages a substantially cup-shaped retainer 42. The rim of the retainer is defined by an outwardly projecting lip 42*a* which is contacted by the upper end 41*b* of the spring, see FIG. 4. The base 42*b* of the retainer is sized so as to fit into the upper end of the spring. The center of the base is provided with a dimple 42*c* which is adapted to accommodate the rounded end 43*a* of an adjusting screw 43. The screw 43 is threaded into the top of housing section 26 so that adjustment of the screw by a screwdriver or the like will vary the tension of the biasing spring 41. Retraction of the valve piece from the valve seat occurs when the pressure within chamber C is reduced to such amount relative to the ambient pressure existing in chamber C′ that the bias of spring 41 is overcome.

As seen in FIG. 5, housing first section 26 is provided with a port **26*b* which is radially offset from the longitudinal axis Q—Q of the fitting opening 34*a*, see FIG. 11. The axis of adjusting screw 43 is coaxial with axis Q—Q. Port 26*b* is adapted to receive a suitable connector 44 which has an end 44*a* thereof projecting radially outwardly from the housing first section 26. The connector may be of conventional design with the projecting end having a bevelled tip to facilitate slipping the end of a vacuum tube or the like, not shown, from the engine over the projecting end 44*a* of the connector. The interior diameter of the tube and the outside diameter of the connector end 44*a*** are such that the tube will snugly engage the connector. Other types of connectors may be utilized if desired.

Thus, by reason of the housing and diaphragm being rotatable about axis Q—Q, the connector 44 can be positioned so that the end of the vacuum tube can be readily connected to the connector. The detents **27*d* formed on the surface 27*c* of the housing section 27 are positioned relative to the opening 27*b* so that they will engage the upper perimetric portions of the facetted surfaces forming the polygonal segment X of the fitting 34 and thus, releasably retain the housing and diaphragm in a selected position of rotational adjustment. When the housing and diaphragm are moved to a second position of rotational adjustment, the corners of the polygonal surface of the fitting 34 will force the surface 27*c* and the detents 27*d* thereof to move upwardly a slight amount overcoming the bias of the spring washer 36. If desired, however, the detents 27*d* may be omitted and the housing and diaphragm retained in a selected position of rotational adjustment solely by the friction established between surfaces 27*c* and 34*c* due to the bias of the spring washer 36**.

It should be noted that when the valve 20 is disassembled from the base member 21, the valve piece 37 is exposed (FIG. 12) and is readily accessible for cleaning or replacement on the stem piece 31. Replacement and/or cleaning of the valve seat 23 positioned in the base member 21 may be readily accomplished when the valve 20 is removed, because the valve seat is accessible through opening 24 and passageway segment **22*b*. No mutilation or further disassembling of the valve is required to clean or replace the valve piece 37 or valve seat 23**.

Thus, a simple, compact, and versatile serviceable valve has been disclosed which can be readily serviced when required and may be readily adjusted so as to facilitate connecting a vacuum tube or the like to a port formed in the valve. While the valve has been described in connection with the recirculation of exhaust gases in an internal combustion engine, it is not intended that the claimed invention is to be limited thereto. The size and shape of the various valve components may vary from that shown and will depend to a substantial extent on the physical dimensions of the space of the vehicle in which the engine is mounted.

I claim:

1. A serviceable valve for controlling the recirculation of exhaust gases within an internal combustion engine, comprising a housing having a first section provided with an interior chamber, and a second section secured to and subtending said first section; a diaphragm affixed to and interposed said housing sections, said diaphragm being in communication with said chamber and in response to a predetermined pressure within said chamber having a portion of the diaphragm movable in one direction from a predetermined rest position; a fitting mounted on and subtending said housing second section whereby said housing and diaphragm are rotatable at least 360° as a unit in either direction about an axis of said fitting to selected positions of adjustment, said fitting being adapted to be removably mounted on the engine; a stem assembly carried by said diaphragm and being movable in response to the movement of said diaphragm portion, said assembly having an elongated stem member operatively connected to said diaphragm and in coaxial relation with said fitting axis, one end of said stem member having a valve piece mounted thereon for coaction with a valve seat provided on the engine and disposed within a recirculation flow path of the exhaust gases within the engine whereby, when said valve piece is seated on the valve seat, recirculation of the exhaust gases through the engine is blocked; a port formed in said housing first section and communicating with the chamber therein, said port being offset with respect to the fitting axis and being adapted to be removably connected to a pressure fluctuating segment of the engine; and means coacting with said fitting and said housing second section to releasably retain said housing and diaphragm in a selected position of rotary adjustment relative to said fitting.

2. A serviceable valve for controlling the recirculation of exhaust gases within an internal combustion engine, comprising a housing having a first section provided with an interior chamber, and a second section secured to and subtending said first section; a diaphragm affixed to and interposed said housing sections, said diaphragm being in communication with said chamber and in response to a predetermined pressure within said chamber having a portion of the diaphragm movable in one direction from a predetermined rest position; a fitting mounted on and subtending said housing second section whereby said housing and diaphragm are rotatable as a unit about an axis of said fitting to selected positions of adjustment, said fitting being adapted to be removably mounted on the engine; a stem assembly carried by said diaphragm and being movable in response to the movement of said diaphragm portion, said assembly having an elongated stem member operatively connected to said diaphragm and in coaxial relation with said fitting axis, one end of said stem member having a valve piece mounted thereon for coaction with a valve seat provided on the engine and disposed within a recirculation flow path of the exhaust gases within the engine whereby, when said valve piece is seated on the valve seat, recirculation of the exhaust gases through the engine is blocked; a port formed in said housing first section and communicating with the chamber therein, said port being offset with respect to the fitting axis and being adapted to be removably connected to a pressure fluctuating segment of the engine; and means coacting with said fitting and said housing second section to releasably retain said housing and diaphragm in a selected position of adjustment relative to said fitting; said fitting including a substantially cylindrical portion protruding upwardly from a surface of said fitting, said protruding portion extending through an opening formed in said housing second section and terminating within the interior thereof, and means coacting with the terminating protruding portion and resiliently biasing the portion of said housing second section circumjacent said opening into a predetermined frictional engagement with said fitting surface and effect retention of said housing and diaphragm in a selected position of adjustment relative to said fitting.

3. The serviceable valve of claim 2 wherein the means coacting with the terminating protruding portion includes an encompassing spring disc washer.

* * * * *